US008256348B1

(12) United States Patent
Fromson et al.

(10) Patent No.: US 8,256,348 B1
(45) Date of Patent: Sep. 4, 2012

(54) REVEAL OF REFERENCE MARKS FOR MOUNTING OF PRINTING PLATES

(75) Inventors: Howard A. Fromson, Stonington, CT (US); Christopher M. Butler, Storrs, CT (US); William J. Ryan, North Granby, CT (US)

(73) Assignee: Anocoil Corporation, Rockville, CT (US)

( * ) Notice: Subject to any disclaimer, the term of this patent is extended or adjusted under 35 U.S.C. 154(b) by 0 days.

(21) Appl. No.: 13/373,772

(22) Filed: Nov. 30, 2011

(51) Int. Cl.
*B41C 1/10* (2006.01)
*B41F 7/00* (2006.01)
*B41M 1/06* (2006.01)

(52) U.S. Cl. ..... 101/463.1; 430/273.1; 430/302; 101/450.1; 101/453; 101/481; 101/485; 101/DIG. 36

(58) Field of Classification Search ..... None
See application file for complete search history.

(56) References Cited

U.S. PATENT DOCUMENTS

| | | | | |
|---|---|---|---|---|
| 4,489,652 | A * | 12/1984 | Takeuchi et al. | 101/211 |
| 5,193,690 | A * | 3/1993 | Powers et al. | 209/558 |
| 5,987,949 | A * | 11/1999 | Palmatier et al. | 72/17.3 |
| 8,137,897 | B2 * | 3/2012 | Fromson et al. | 430/302 |
| 2004/0237821 | A1 * | 12/2004 | Fromson et al. | 101/465 |

* cited by examiner

*Primary Examiner* — Joshua D Zimmerman
(74) *Attorney, Agent, or Firm* — Alix, Yale & Ristas, LLP

(57) ABSTRACT

A method for preparing lithographic printing plates for on-press development, including sequentially feeding the plates to an imaging station to produce a plurality of latent image reference marks allocated among at least two margins along a respective two sides of the plate, and a latent print image within the margins. The imaged plates are transported from the imaging station to a plate bending station where the short ends of the plate are bent over. Between the imaging station and the bending station, the unimaged areas of the coating in at least two of the margins are removed to reveal the reference marks without developing the latent print image. Preferably, the reference marks are revealed while the plate is temporarily aligned in landscape orientation at stop, such as at the feeder to the bending station.

21 Claims, 4 Drawing Sheets

REVEAL OF REFERENCE MARKS FOR MOUNTING OF PRINTING PLATES

BACKGROUND

The present invention is in the field of lithographic printing, and relates in particular to the steps for preparing imageable or imaged printing plates for mounting on a plate cylinder of a printing press.

Common practice in the newspaper printing industry includes the steps of radiation imaging a photosensitive coating on a plate as supplied by the plate manufacturer, developing the plate by chemically reacting the imaged coating with an aqueous fluid, and bending each end (head and tail) of the developed plate before delivering the plate to the press where the plate is mounted on the plate cylinder of the press. The imaging step includes at least three reference marks in the margins of the plate, at corners. Developing reveals at least the reference marks as well as the main imaged areas of the plate.

The acute bends in the head and tail of the plate allow for the accurate attachment of the plate to the printing press cylinder. These acute bends slip into grippers that tightly hold the plate to the cylinder when the press is in operation. The accuracy of the head and tail plate bends is critical to within thousandths of an inch. Automated vision bending equipment uses cameras to define the exact location of each bend. These cameras detect the reference marks on the head and tail of the plate.

This way of revealing reference marks is not compatible with the growing interest in so called "on-press" development, whereby the step of developing the plate in a fluid before mounting the plate on press is avoided because the plate is developed by dissolution or dispersion in the fountain fluid while it is on the plate cylinder of the press. Instead, the coating includes a dye component that discolors when imaged, thereby rendering the reference marks and all the imaged areas of the coating somewhat visible before the plate reaches the bending tool. This discoloration has low contrast relative to the unimaged coating around it, resulting in degradation in positional detection and thus in the accuracy of the bends. Although special cameras are being designed to accommodate the lower contrast reference marks, success has so far been limited.

SUMMARY

One disclosed embodiment is directed to a method for revealing margin references marks in a rectangular lithographic printing plate comprising initially transporting the imaged plate in portrait orientation along a first transport direction, secondarily transporting the imaged plate in landscape orientation, and at a fixed stop after the plate has been transported in landscape orientation, developing at least a portion of the margins of the coating at the short sides (head and tail) to reveal the reference marks.

Another disclosed embodiment is directed to a method for preparing lithographic printing plates for on-press development. Rectangular plates having an overlying, radiation polymerizable coating are sequentially fed to an imaging station where a plurality of latent image reference marks are produced among at least two margins along a respective two sides of the plate, and a latent print image is produced within the margins. The imaged plates are transported from the imaging station to a plate bending station where the heads and tails of the plate are bent over. Between the imaging station and the bending station, the unimaged areas of the coating are removed only in at least two of the margins to reveal the reference marks.

A preferred embodiment is also directed to a method for preparing lithographic printing plates for on-press development, from a supply of rectangular plates having short sides and long sides, a substrate, and an overlying, radiation polymerizable coating. The plates are sequentially fed to an imaging station where the coating is radiation imaged to produce a plurality of latent image reference marks allocated among at least two margins along a respective two sides of the plate, and a latent print image within the margins. The plates emerge in a portrait orientation and travel along a first transport direction whereby the long sides are parallel to the transport direction. The imaged plate is then reoriented to landscape whereby the short sides are parallel to a second transport direction along which the imaged plate is delivered to a margin developing station. At the margin developing station, the unimaged areas of the coating are removed only in the margins to reveal the reference marks. The plates with revealed reference marks are fed in landscape orientation to a bending station where the plates are bent in dependence on detection of the reference marks. The bent plates are mounted to a plate cylinder of a printing press and while the plate is mounted on the plate cylinder, the latent print image is developed within the margins.

Preferably, the reference marks are revealed while the plate is held in an aligned position, especially adjacent the feeder for the bending station.

The method is especially suited for use wherein the coating is soluble in solvent but not water or fountain fluid, the unimaged areas have cohesion that is greater than adhesion to the substrate, and the unimaged areas within the margin are removed (i.e., the print areas of the plate is fully developed) by press ink pulling the unimaged areas of the coating off the substrate and transferring the pulled off coating to a press blanket, without chemical reaction. However, the method is also usable with water soluble coatings.

The method avoids the need in the prior art for special dyes in the coating so that the reference marks can be seen as a color change in the coating when the plate is imaged. Since in the prior art the entire coating includes this dye, the subsequent on-press development of the plate via chemical reaction, releases this dye into the press fluids and can adversely affect the color and emulsive qualities of the ink. With the preferred embodiment, the coating surrounding the imaged areas for the reference mark (and page number) are removed by chemical reaction upstream of the bending tool, but the unimaged areas of the main surface of the coating are removed on press as solid particles by the mechanical tension of the ink. During a relatively small number of press roll rotations, all the unimaged coating is transferred as particles by the blanket to waste leader, and coating material does not dissolve into the press fluids.

This advantage is achieved without the need for replacing equipment or altering the footprint of conventional press room set-up for the sequence of imaging, bending, mounting, and on-press developing of plates. The developing station for revealing the reference marks can be located anywhere between imaging and bending, but most effectively at a location where every plate is temporarily stationary and aligned in the same position. One such location is where the plates hit a stop for reorientation from portrait transport to landscape transport, and another such location is a stop for the landscape transport, at the feed of the plate bending station. The equipment for revealing the reference marks can straddle the frame and cantilever or arch over the belt, slats or paddles of the plate conveyors.

BRIEF DESCRIPTION OF THE DRAWING

The invention will be disclosed through descriptions of various embodiments with reference to the accompanying drawing, in which.

DETAILED DESCRIPTION

Figure 1:
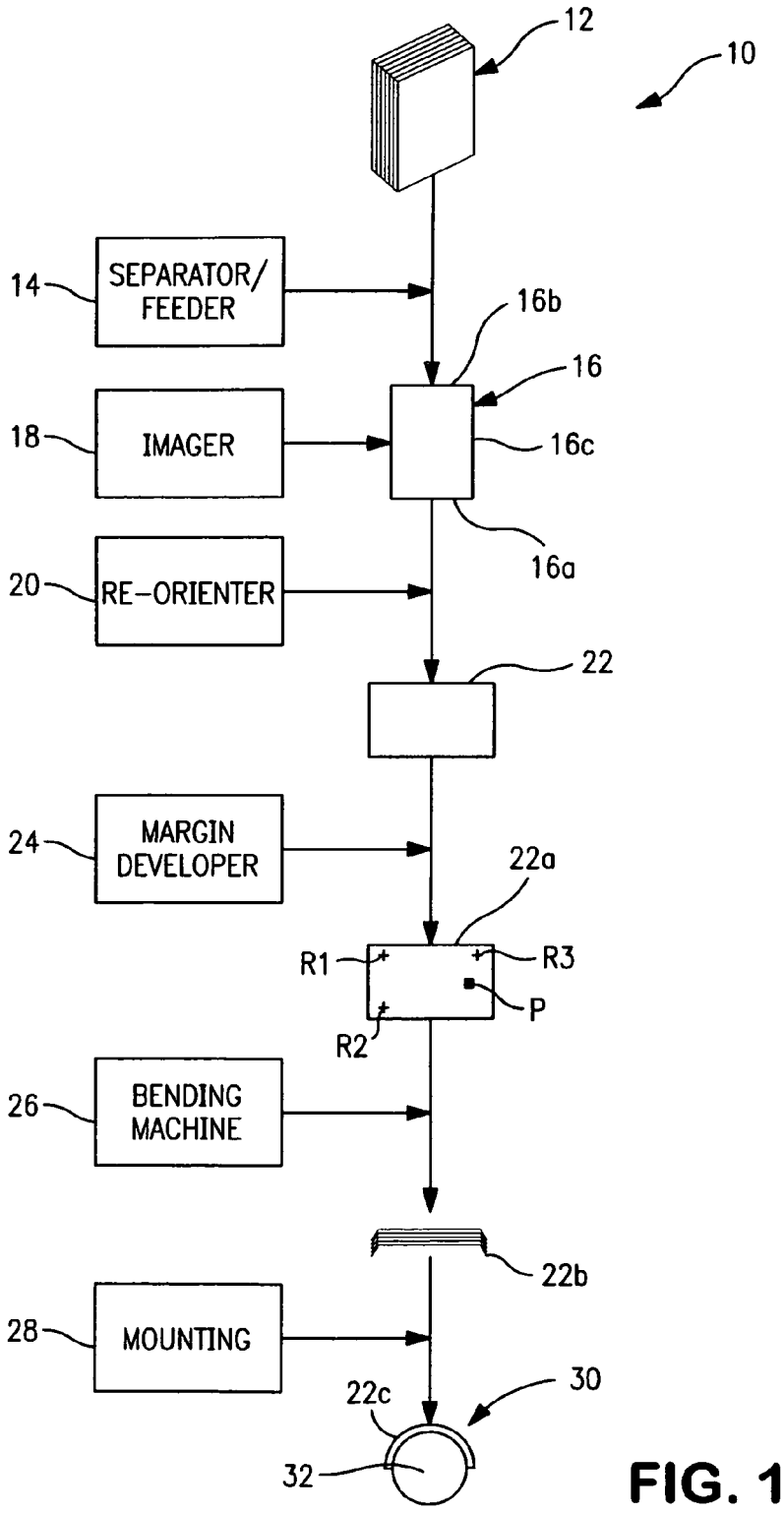
FIG. 1 is a schematic of a generic embodiment of the invention in a portion of a newspaper press room operation for the imaging, bending, mounting, and on-press development of a lithographic plate.

FIG. 1 is a schematic of a general method representing a series of components or equipment in a vertical sequence from top to bottom on the left, and the associated travel or transport of the plates on the right as they pass through this equipment. Portion 10 of a newspaper press room as represented in FIG. 1, covers the sequence of imaging, bending, mounting, and on-press development of the plates. A stack or supply 12 of rectangular plates is delivered by a separator and feeder 14 in a portrait mode orientation, such that each plate 16 has opposed short sides 16*a* and 16*b* (head and tail, respectively) and opposed long sides 16*c*, whereby the long sides are parallel to the transport direction. The plates are constituted essentially by a thin metal substrate, such as a grained and anodized aluminum sheet, overlaid with a photosensitive coating, preferably a coating in which all active components for photo polymerization are soluble in organic solvent, but insoluble in water.

At the imaging station 18, the plates are imagewise exposed to produce a plurality of latent image reference marks in the margins and a latent print image within the margins. Typically, a page number is also imaged in the print image area, adjacent a margin. It should be appreciated that the margins are not physically delineated, but rather have dimensions that are well known in the industry and dependent on the particular overall dimensions of the plate. Generally, three latent reference marks are required in a respective three corners of the plate.

At some point during the continued transport of the plate 16, a reorienting device alters the relationship of the plate to the plate transport direction. In FIG. 1, the initial and subsequent transport directions are aligned, with the plate reoriented at 20 from portrait as shown as 16 to landscape as shown at 22, whereby the plate is transported with the head and tail parallel to the transport direction. While in the landscape orientation, an edge or margin developer 24 removes the unimaged coating surrounding the latent image of the reference and page marks thereby revealing the marks R1, R2, and R3 and P in high contrast relative to the surrounding substrate. The plate 22*a* with revealed marks is fed to bending machine 26 where the head and tail are precisely bent over. Typically, the bent plates are stacked or accumulated such as shown in 22*b*, but can be directly fed to automated equipment 28 at the press where the plate 22*c* is precisely secured to the plate or print cylinder 32 as shown at 30.

Each of the operations described with respect to FIG. 1 is common practice in newspaper press rooms, except for the operation in which between imaging station 18 and the bending station 26, unimaged areas of the coating only in at least two of the margins are removed, to reveal the plurality of reference marks, R1, R2, R3.

Figure 2:
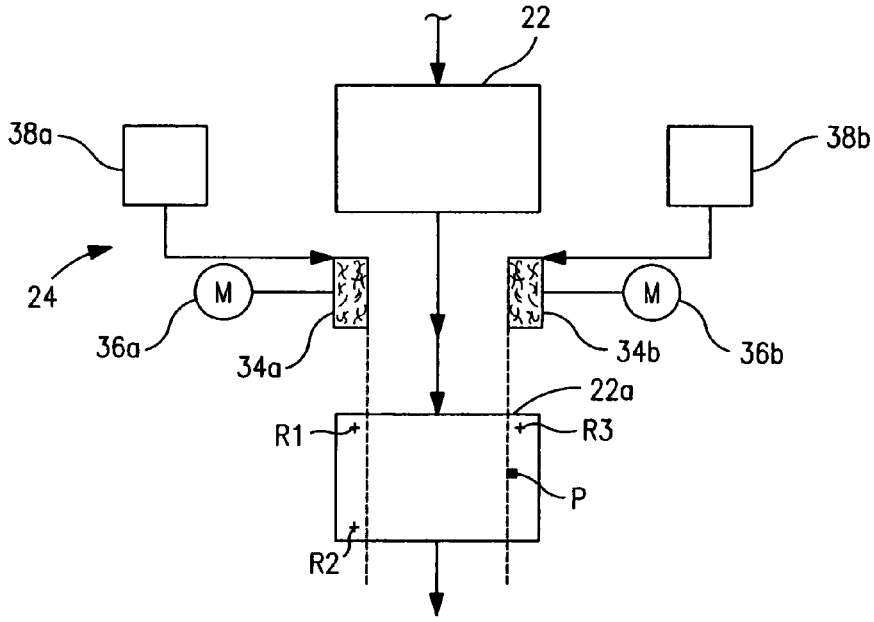
FIG. 2 is a schematic representation of a developing station for removing unimaged coating at the margins of the head and tail of the plate.

FIG. 2 schematically shows one technique for removing the unimaged coating at the head and tail margins. The plate 22 arrives in landscape orientation and passes below a pair of spaced apart brushes 34*a*, 34*b* that are rotated by respective motors 34*a*, 34*b* while being respectively supplied from a source of solvent 38*a*, 38*b*. Although these are shown as distinct configurations, it would be well within the skill of ordinary practitioners to provide a functionally equivalent arrangement using, for example, only one motor and only one source of solvent.

Figure 3:
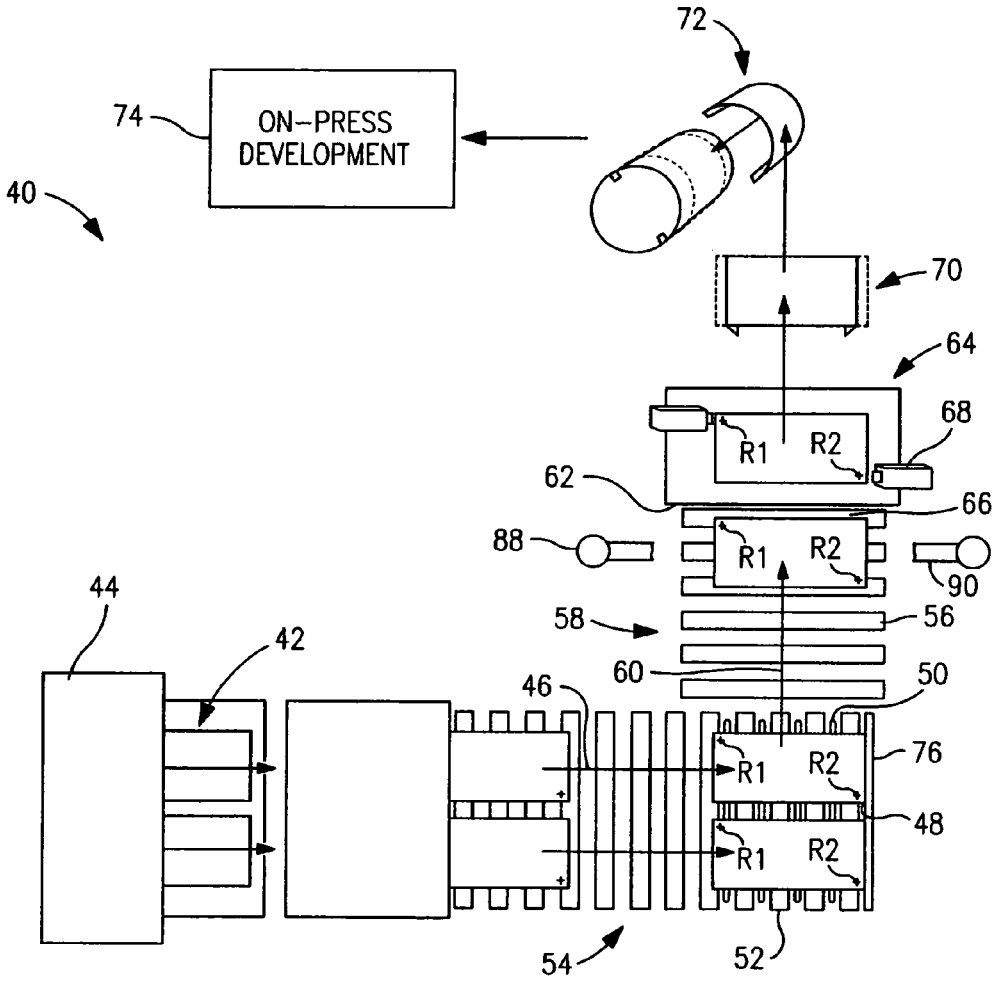
FIG. 3 is a schematic of the preferred embodiment.

Provided the plates are consistently retained on the transporter, the brushes 34*a*, 34*b* can be stationary while the plate 22 moves along the brushes, thereby removing unimaged material from the entire margins at the head and tail. Alternatively and preferably, the plate 22 is temporarily aligned at a fixed stop or the like, and the brushes are translated horizontally along the head and tail margins of the stationary plate. It should be appreciated that whereas the revealed marks must have a precise relationship and high contrast for optimum detection in the bending machine, the removal of the coating around the latent reference marks does not require such high precision in the alignment of the brushes with the reference marks, because the brushes operate on a relatively wide area of margin (e.g. ½ inch) as compared to the dimensions of the reference mark. One or both brushes should be wide enough to extend inwardly from the margin to also reveal the page number FIG. 3 shows a schematic that is more representative of an actual press room setup 40, in which a pair of plates 42 are arranged side-by-side for imaging at 44 and transported along a first direction 46 to a stop surface 48 at which they are picked up by fingers 50 situated between the slats 52 of the first conveyor 54 and deposited on the slats 56 of the second conveyor 58 that transports the plates in a second direction 60 that is perpendicular to the first direction. The plates have thus been reoriented such that they travel in the second direction with the head and tail parallel to the direction of travel, i.e., in landscape orientation. At a location during the landscape travel, and preferably immediately upstream of the feed 62 for the bending machine 64, the margins of the plates are developed to reveal the reference marks indicated as R1 and R2 in FIG. 3. The margins are developed while the plate is stationary at a second alignment stop 66, which may already be present at the in-feed of the bending machine, or may be easily added for implementing the margin development.

When the plate enters the bending machine 64, cameras 68 recognize the reference marks R1, R2 and using automated equipment well known in the art, precisely bend the head and tail downwardly as shown at 70.

As shown at 72, the plate is brought to the press operator who locks one bend into the gripper on the plate cylinder, the plate is wrapped around the cylinder, and the other bend is locked in the opposite gripper. The press is then started and as indicated at 74 the remainder of the unimaged coating is removed on-press, thereby revealing the oliophilic areas within the margin that ultimately pick up ink, transfer the ink to a blanket, which blanket transfers the ink in the desired print pattern onto the paper or similar media.

In the most general implementation, the process associated with the on-press development can take a variety of forms, but in general the mechanism requires multiple rotations of the press cylinder, with or without fountain fluid, or with or without contact with the blanket, until the plate has been fully cleaned out of uncoated material and the remaining oliophilic areas of coating very closely conform with the dot boundaries established in the imaging step.

Although it is preferred that the reference marks be revealed while the plates are stationary relative to the transport and landscape orientation, the reveal of the marks can be achieved while the plates are in portrait orientation, such as at the stop 48 where the transport direction is changed. The head 76 of the plate reaches the stop surface 48 and the fingers 50 for lifting the plates onto the subsequent conveyor can be delayed a sufficient time for development of the margins. Moreover, since every corner represents an intersection of a long edge margin or a short edge margin, two or three reference marks can be revealed by two spaced-apart brushes traveling either along the longitudinal margins or the transverse margins.

Figure 4:
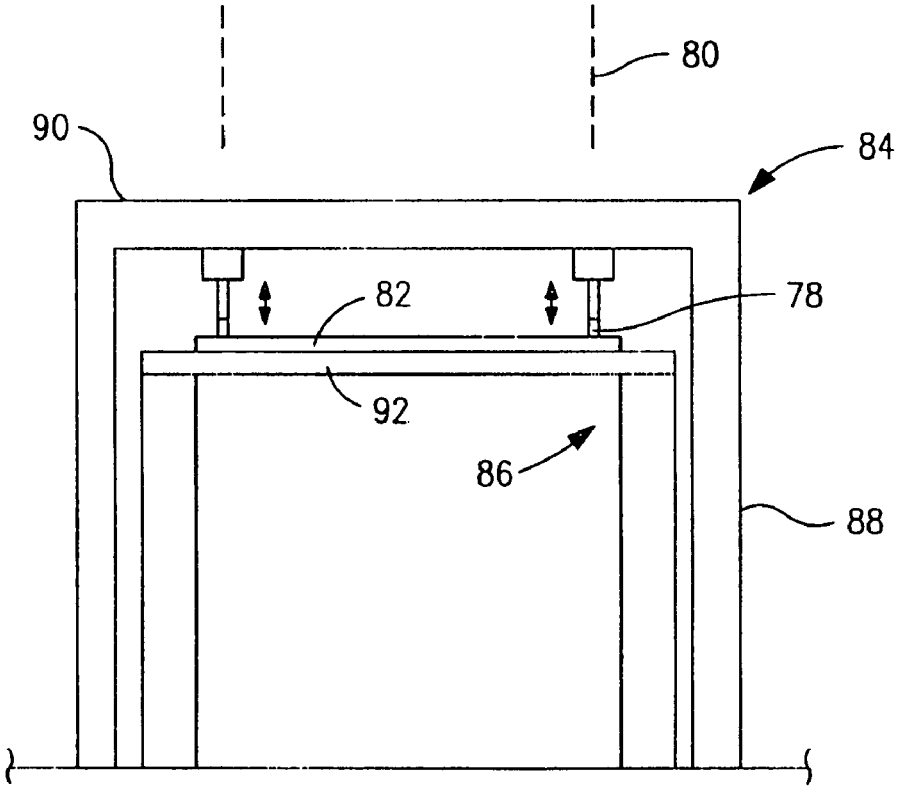
FIG. 4 shows the functional features of an alternative margin developing station.

In yet another embodiment shown in FIGS. 3 and 4, the reference marks can be revealed by a set of brushes 78 or tabs that are rotated about and simultaneously displaceable along vertical axes 80 situated above each reference mark when the plate 82 is in an aligned position, preferably at the in-feed to the bending station. Equipment 84 for revealing the reference marks can straddle the conveyor frame 86 on posts 88 and cantilever or arch 90 over the belt 92 or the like of the conveyor.

The invention claimed is:

1. A method for revealing margin references marks R1, R2, R3 in a rectangular lithographic printing plate having short sides and long sides and an imaged coating comprising two margins and a main print pattern within said margins, comprising:

initially transporting the imaged plate in portrait orientation along a first transport direction whereby the long sides are parallel to the transport direction;

secondarily transporting the imaged plate in landscape orientation whereby the short sides are parallel to a second transport direction;

at a fixed stop after the plate has been transported in landscape orientation, developing at least a portion of the margins of the coating at the short sides to reveal the reference marks, without developing the main print pattern of the coating.

2. The method of claim 1, wherein while the plate is in landscape orientation, continuing to transport the plate with revealed reference marks to a plate bending machine where the short sides of the plate are bent downwardly at an acute angle.

3. The method of claim 2, wherein the references marks are in at least three corners of the plate;

two margins of the coating extend in the transport direction along the short sides of the plate; and at least a portion of only said two margins are developed by respective two devices spaced apart parallel to the long sides at said two margins.

4. The method of claim 3, wherein the coating is solvent-soluble; and the devices apply solvent only at said two margins.

5. The method of claim 4, wherein said device includes brushes which together with said solvent develop each of said two margins entirely.

6. The method of claim 4, wherein said device includes a set of vertically displaceable brushes that each rotate about a vertical axis and simultaneously remove unimaged coating on the reference marks.

7. The method of claim 1, wherein the coating is imaged with said reference marks in two margins, with a main print pattern within the margins, and with a page number adjacent any one margin; and the reference marks and the page number are revealed at said stop, without developing the main print pattern.

8. A method for preparing lithographic printing plates for on-press development, comprising:

from a supply of rectangular plates having short sides and long sides, a substrate, and an overlying, radiation polymerizable coating, sequentially feeding said plates to an imaging station to produce a plurality of latent image reference marks allocated among at least two margins along a respective two sides of the plate, and a latent print image within the margins;

transporting the imaged plates from the imaging station to a plate bending station where the short ends of the plate are bent over; and between the imaging station and the bending station, removing unimaged areas of the coating in at least two of said margins to reveal the reference marks without developing the latent print image.

9. The method of 8, wherein the reference marks are revealed by a brush with solvent in relative horizontal translation with said at least two margins.

10. The method of claim 8, wherein the reference marks are revealed while the plate is held in an aligned position.

11. The method of claim 8, wherein the plates are transported from the imaging station in portrait orientation whereby the long sides are parallel to the transport direction;

the plates are reoriented and transported to the bending station in landscape orientation whereby the short sides are parallel to the transport direction; and the plates in landscape orientation are held in an aligned position immediately upstream of the bending station and the reference marks are revealed while the plate is in said aligned position.

12. The method of claim 11, wherein the reference marks are revealed by a brush with solvent passing along each margin at the short sides of the plate.

13. The method of claim 11, wherein the reference marks are revealed by a brush that is rotated about and displaceable along a vertical axis situated above each reference mark when the plate is in the aligned position.

14. The method of claim 8, wherein the coating is imaged with a page number adjacent any one margin; and the reference marks and the page number are revealed without developing the latent print image.

15. A method for preparing lithographic printing plates for on-press development, comprising:

from a supply of rectangular plates having short sides and long sides, a substrate, and an overlying, radiation polymerizable coating, sequentially feeding said plates in a first transport direction to an imaging station in a portrait orientation whereby the long sides are parallel to the transport direction;

at the imaging station, radiation imaging the coating to produce a plurality of latent image reference marks allocated among at least two margins along a respective two sides of the plate, and a latent print image within the margins;

reorienting the imaged plates to landscape whereby the short sides are parallel to a second transport direction;

transporting the imaged plates in landscape orientation in said second direction to a margin developing station;

at the margin developing station, removing unimaged areas of the coating in said margins to reveal the reference marks, wherein the latent print image within the margins is not developed;

feeding the plates with revealed reference marks R1, R2, R3 in landscape orientation to a bending station where the plates are bent in dependence on detection of the reference marks;

mounting the bent plates to a plate cylinder of a printing press; and while the plate is mounted on the plate cylinder, developing the latent print image within the margins.

16. The method of claim 15, wherein the reference marks are revealed while the plate is held in an aligned position at the margin developing station.

17. The method of claim 15, wherein said removal of the unimaged areas of the coating in said margins includes developing at least portions of two margins of the coating only at the short sides of the reoriented plate to reveal the reference marks.

18. The method of claim 15, wherein two margins of the coating extend in the transport direction along the short sides of the plate; and at least portions of the two margins are developed by respective two devices spaced apart parallel to the long sides at said two margins.

19. The method of claim 15, wherein the coating is solvent-soluble;

two margins of the coating extend in the transport direction along the short sides of the plate;

the two margins are developed by respective two devices spaced apart parallel to the long sides applying solvent only to the two margins.

20. The method of claim 16 including on press development of the plate as mounted on the plate roll, by removing unimaged coating within the margins to reveal a pattern of oleophilic image areas of the coating and hydrophilic areas of substrate where unimaged coating has been removed.

21. The method of claim 20, wherein the coating is soluble in solvent but not water or fountain fluid;

the unimaged areas have cohesion that is greater than adhesion to the substrate; and the unimaged areas are removed within the margins by press ink pulling the unimaged areas of the coating off the substrate and transferring the pulled off coating to a press blanket, without chemical reaction.

* * * * *